US010785584B2

(12) United States Patent
Farmakidis et al.

(10) Patent No.: US 10,785,584 B2
(45) Date of Patent: Sep. 22, 2020

(54) HEARING AID WITH ELECTRONICS FRAME AND ANTENNA INTEGRATED THEREIN

(71) Applicant: SIVANTOS PTE. LTD., Singapore (SG)

(72) Inventors: Constantine Farmakidis, Lancashire (GB); Oliver Nipp, Eckental (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/406,278

(22) Filed: May 8, 2019

(65) Prior Publication Data

US 2019/0349694 A1 Nov. 14, 2019

(30) Foreign Application Priority Data

May 8, 2018 (DE) ..... 10 2018 207 179

(51) Int. Cl.
*H04R 25/00* (2006.01)
*H01Q 1/27* (2006.01)

(52) U.S. Cl.
CPC ..... *H04R 25/60* (2013.01); *H01Q 1/273* (2013.01); *H04R 25/554* (2013.01); *H04R 25/65* (2013.01); *H04R 2225/51* (2013.01)

(58) Field of Classification Search
CPC ..... H04R 25/60; H04R 25/554; H04R 25/65; H04R 2225/51; H01Q 1/273
USPC ..... 381/324
See application file for complete search history.

(56) References Cited

U.S. PATENT DOCUMENTS

| | | | | |
|---|---|---|---|---|
| 9,571,944 | B2 | 2/2017 | Fischer et al. | |
| 9,980,062 | B2 | 5/2018 | Fischer et al. | |
| 2011/0081031 | A1* | 4/2011 | Abolfathi | H04R 1/46 381/151 |
| 2014/0010394 | A1* | 1/2014 | Kvist | H04R 25/554 381/315 |
| 2015/0131829 | A1* | 5/2015 | Akdeniz | H04R 25/554 381/315 |
| 2017/0064467 | A1 | 3/2017 | Fischer et al. | |
| 2018/0139548 | A1* | 5/2018 | Kuhn | H04R 25/65 |
| 2020/0091592 | A1* | 3/2020 | Abadia | H01Q 7/00 |

FOREIGN PATENT DOCUMENTS

| | | | |
|---|---|---|---|
| EP | 2723101 | A2 | 4/2014 |
| EP | 2824942 | A1 | 1/2015 |
| WO | 2014090419 | A1 | 6/2014 |

* cited by examiner

*Primary Examiner* — Sean H Nguyen
(74) *Attorney, Agent, or Firm* — Laurence A. Greenberg; Werner H. Stemer; Ralph E. Locher

(57) ABSTRACT

A hearing aid includes a housing and a frame inserted in the housing and serving to receive electrical or electronic assemblies which include a transmitting and/or receiving unit for electromagnetic waves. The frame includes an associated antenna configured as an integral part of the frame, as a stamped/bent part or as an inlay part made of metal. The antenna includes a first part with two ends. The first part in particular has a winding profile or is configured as an open loop, and a segment along the profile of the first part forms a first auxiliary structure having the shape of a closed loop.

9 Claims, 2 Drawing Sheets

HEARING AID WITH ELECTRONICS FRAME AND ANTENNA INTEGRATED THEREIN

CROSS-REFERENCE TO RELATED APPLICATION

This application claims the priority, under 35 U.S.C. § 119, of German Patent Application DE 10 2018 207 179.9, filed May 8, 2018; the prior application is herewith incorporated by reference in its entirety.

BACKGROUND OF THE INVENTION

Field of the Invention

The invention relates to a hearing aid with a housing, a frame inserted in the housing and serving to receive electrical or electronic assemblies which include a transmitting and/or receiving unit for electromagnetic waves and an associated antenna, in which the antenna is configured as an integral part of the frame, as a stamped/bent part or as an inlay part made of metal.

Hearing devices are known per se and are described in great detail in various publications, for example in International Publication WO 2014/090419 A1, corresponding to U.S. Pat. Nos. 9,571,944 and 9,980,062. "Hearing aids" include portable hearing devices that serve to assist those with hearing impairments. In order to satisfy numerous individual needs, various structural types of hearing aids are made available, such as behind-the-ear hearing aids (BTE), hearing aids with an external receiver (RIC: receiver-in-canal), and in-the-ear hearing aids (ITE), e.g. also concha hearing aids or canal hearing aids (ITE, CIC). The listed examples of hearing aids are worn on the outer ear or in the auditory canal. In addition, however, bone conduction hearing aids, implantable or vibrotactile hearing aids, are also available on the market. In those, the damaged hearing is stimulated either mechanically or electrically. Such hearing aids are also designated as "hearing devices."

In addition to the classic hearing aids described above, hearing aids have also recently been developed that assist people with normal hearing. Such hearing aids are also referred to as "Personal Sound Amplification Products" or "Personal Sound Amplification Devices" (abbreviated to "PSAD"). Those hearing aids are not provided to compensate for hearing losses. Instead, such hearing aids are used precisely to assist and improve normal human hearing capacity in specific hearing situations, e.g. to assist hunters out on the hunt, or in order to assist in the observation of animals, to be better able to perceive animal noises and other sounds generated by animals, for sports reporters in order to permit improved speaking and/or speech understanding under difficult conditions, for musicians, in order to reduce the strain on their hearing, and so on.

In principle, the basic components of hearing aids are an input transducer, an amplifier and an output transducer. The input transducer is normally an acoustic-electric transducer, e.g. a microphone, and/or an electromagnetic receiver, e.g. an induction coil. The output transducer is generally realized as an electroacoustic transducer, e.g. a miniature loudspeaker (receiver), or an electromechanical transducer, e.g. a bone-conduction receiver. The amplifier is usually integrated in a signal-processing device.

Modern hearing aids are often equipped with transmitting and/or receiving units that permit wireless communication with other electronic devices, in particular with other hearing aids (e.g. in order to form a binaural hearing aid system), remote controls, programming devices or cell phones. The wireless communication is often effected by using electromagnetic waves in the radiofrequency range, e.g. using Bluetooth technology at 2.4 GHz.

A problem with hearing aids lies in the realization of the (RF) antennas needed for them, since standard antenna constructions cannot easily be used due to the free-space wavelength (corresponding to the above-mentioned frequency range) of more than 10 cm and due to the electrically small volume of conventional hearing aids. That problem is becoming increasingly important as the miniaturization of hearing aids gathers pace.

In the hearing aid known from International Publication WO 2014/090419 A1, corresponding to U.S. Pat. Nos. 9,571,944 and 9,980,062, the antenna is formed by a conductive structure which is an integral part of the (electronics) frame of the hearing aid. That allows the antenna to be accommodated in a space-saving manner in the housing of the hearing aid. Moreover, the antenna can be installed with the frame in a large number of different housings, without the antenna construction always having to be reconfigured.

SUMMARY OF THE INVENTION

It is accordingly an object of the invention to provide a hearing aid with an electronics frame and an antenna integrated therein, which overcomes the hereinafore-mentioned disadvantages of the heretofore-known hearing aids of this general type and which improves the antenna construction known from International Publication WO 2014/090419 A1, corresponding to U.S. Pat. Nos. 9,571,944 and 9,980,062.

With the foregoing and other objects in view there is provided, in accordance with the invention, a hearing aid which comprises a housing and, inserted in the housing, an (electronics) frame for receiving electrical and/or electronic assemblies. The assemblies received in the frame include a transmitting and/or receiving unit for electromagnetic waves, in particular radio waves in the MHz or GHz range, e.g. 2.44 GHz (corresponding approximately to a wavelength of 65 mm). The hearing aid moreover includes an antenna which is assigned to the transmitting and/or receiving unit and which is configured as an integral part of the frame. Integral part is to be understood in this case in particular as meaning that the antenna or a structure partially or completely forming the antenna cannot be released from the frame without destruction and/or is substantially part of the outer shape of the frame, i.e. does not protrude much therefrom, wherein the frame is made of a different, non-conductive material, in particular a plastic. In an alternative embodiment of the invention, the antenna is constructed as a stamped/bent part (connected to the frame) or as an inlay part (connected to the frame) made of metal.

According to the invention, the antenna moreover has a first part, which in particular has a winding profile or is configured as an open loop with two ends. That is to say, the first part usually has a non-rectilinear profile, typically with several changes of direction, for example a meandering configuration. Moreover, a segment along the profile of the first part forms a first auxiliary structure having the shape of a closed loop, for example a kind of ring shape or an oval shape.

With this auxiliary structure, the effective length of the antenna-forming structure is then increased, without this requiring a greater surface area for accommodating the antenna. That is to say, the space available for the antenna or the surface area available for the antenna is utilized more effectively in this way. In addition, the radiating characteristics of the antenna can be favorably influenced by this auxiliary structure, particularly with regard to the intensity and spatial angle of the radiation. In addition, the auxiliary structure permits a relatively good impedance adaptation to an impedance of 50Ω.

It is furthermore advantageous if the frame has an upper face, an underside and two mutually opposite flanks, and if the first auxiliary structure is positioned on one of the two flanks of the frame. In this case, side region or flank designates a side of the frame that interconnects the upper face and the underside of the frame. The corresponding designation of the sides of the frame with upper face, underside and flank relates to the intended orientation of the hearing aid relative to a wearer or user of the hearing aid while wearing the corresponding hearing aid. The underside of the frame then typically points in the direction of the torso of the user or wearer, and one of the two flanks or one of the side regions points in the direction of the head, while the other of the two flanks or the other of the two side regions is directed away from the head. The resulting relative configuration and/or orientation of the first auxiliary structure relative to the user or wearer of the hearing aid is relevant with regard to the radiating characteristics of the antenna during transmission.

In an advantageous development, the antenna additionally includes a second part, which in particular has a winding profile or is configured as an open loop with two ends. The two parts of the antenna are preferably electrically shorted to each other at one of their ends by a bridge, and the bridge is configured in particular as an integral part of the frame. Such a bridge or a part of such a bridge is formed, for example, by at least one electrical conductor track which completely or at least partially bridges the distance between the short-circuit ends of the parts of the antenna and which is therefore referred to below as a "bridging conductor." Like the whole antenna, the bridging conductor or each bridging conductor is configured in this case as an integral part of the frame, a stamped/bent part or inlay part.

It is expedient if the two parts of the antenna are positioned on the two mutually opposite flanks of the frame. In particular, in this case the bridge is preferably routed over the upper face at the frame.

In an embodiment variant, the frame is moreover formed from two frame halves, wherein the first part of the antenna is disposed on one of the two frame halves, and the second part of the antenna is disposed on the other of the two frame halves.

It is additionally advantageous if the two parts, i.e. the first part of the antenna and the second part of the antenna, are formed symmetrically to each other with respect to a separating plane that separates the frame halves. The symmetrical configuration of the antenna advantageously facilitates a side-independent use of the hearing aid. This feature in other words allows one and the same housing, including the frame and the components received in the latter, to be used both for use on the left ear and also for use on the right ear.

However, in differing embodiments of the invention, the two parts of the antenna can also be formed asymmetrically with respect to each other. The asymmetric configuration of the two parts is preferably always chosen when a symmetrical configuration of the parts would lead to stronger electromagnetic interference between the antenna and the other electrical or electronic assemblies in or on the frame. The asymmetry between the two parts is preferably slight. The parts of the antenna are in particular made as symmetrical as possible while avoiding such interference.

In addition, the antenna is usually constructed as a folded dipole antenna and, according to an embodiment variant, the two ends of both parts of the antenna are disposed at the same longitudinal end of the frame.

Moreover, a segment along the profile of the second part of the antenna preferably forms a second auxiliary structure having the shape of a closed loop.

The geometric configuration of the auxiliary structures is typically adapted to the particular use. According to an embodiment variant, at least one auxiliary structure, in particular each auxiliary structure, has a substantially elliptical shape or an oval shape. In the case of a substantially elliptical shape, the main axis of the elliptical shape is then preferably oriented vertically, i.e. vertically with respect to the earth system. A tapering shape is also useful for one of the auxiliary structures or for both auxiliary structures. In particular, if at least one auxiliary structure or each auxiliary structure has an elliptical shape, it preferably tapers to a point at both ends of its main axis.

Through the integration of the antenna on the frame, in combination with the special configuration of the antenna, it is considerably easier, as has already been explained above, to obtain the antenna length that is necessary for effective transmitting and/or receiving characteristics of the antenna. Each part of the antenna then preferably has a (line) length which corresponds with good approximation to a quarter or an eighth of the wavelength of the radio waves for which the transmitting and/or receiving unit is constructed.

According to a further advantageous embodiment of the hearing aid, the frame is produced from a non-conductive material, in particular a plastic, that has a higher permittivity than the material of the housing. In particular, the frame material of the hearing aid according to the invention also has a higher permittivity than materials that are generally used for electronics frames of conventional hearing aids. In particular, the frame material of the hearing aid according to the invention has a relative permittivity of at least 3.8, preferably at least 4.5. It has been found that the increased permittivity of the frame material as a result of dielectric interaction with the electromagnetic field that is produced or received by the antenna allows significant shortening of the antenna length at given transmitting/receiving characteristics. This in turn represents a considerable advantage for accommodating the antenna on the frame.

In order to provide for the integration of the antenna or parts of the antenna in the frame, the surface of the frame is preferably first of all structured in such a way that, when the conductive layer is applied, the latter is applied only as per the structuring. This is effected, for example, by using laser direct structuring (LDS). The surface of the frame in this case is treated with a laser in such a way that a conductor track deposits only on the treated locations in an electroplating bath.

In another embodiment of the method, a conductive layer is first of all applied to the surface of the frame, after which the conductive layer is structured. In this case, the conductive layer is applied, for example, by bonding, sputtering or some other measures.

In a further alternative in this context, the antenna is printed onto the frame, or parts of the antenna are printed onto the frame.

Other features which are considered as characteristic for the invention are set forth in the appended claims.

Although the invention is illustrated and described herein as embodied in a hearing aid with an electronics frame and an antenna integrated therein, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
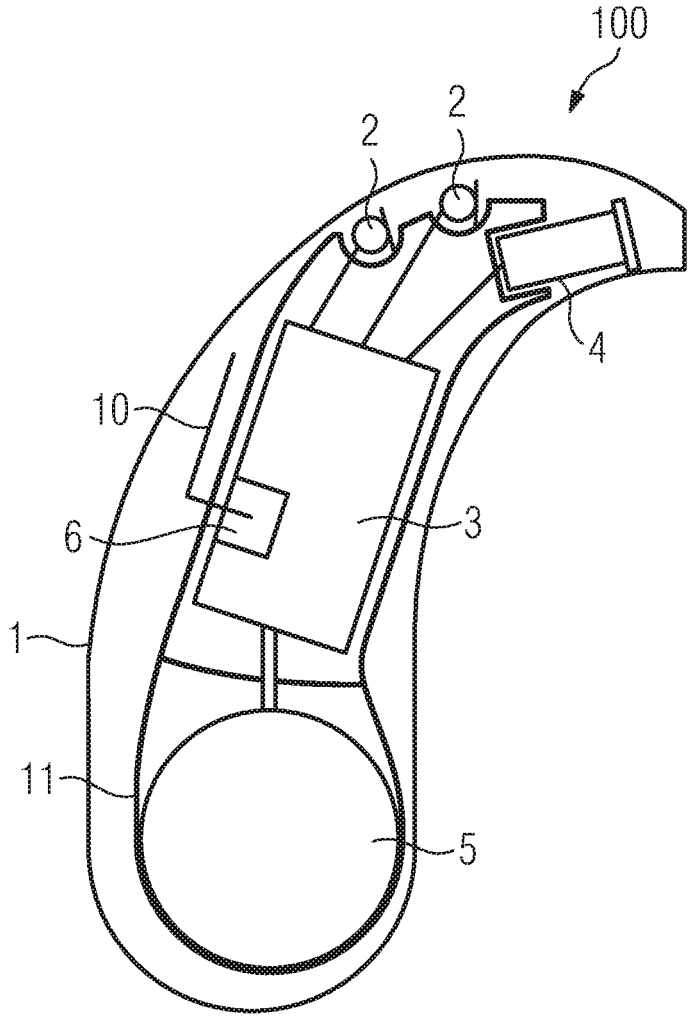
FIG. 1 is a diagrammatic, longitudinal-sectional view of a hearing aid.

Referring now in detail to the figures of the drawings, in which parts that correspond to each other are always provided with the same reference signs, and first, particularly, to FIG. 1 thereof, there are simply seen principal elements of a hearing aid 100, without reproducing the true positions, connections or shapes of those elements.

The embodiment shown in FIG. 1 is a behind-the-ear hearing aid 100. However, the invention is also conceivable for in-the-ear hearing aids, in which case there is then a different configuration of the components shown.

The hearing aid 100 has a housing 1 which is made of plastic and in which a frame 11 is inserted. The frame 11 is preferably an injection-molded plastics part. The frame 11 serves generally to hold electrical and electronic assemblies of the hearing aid 100 and to fix these assemblies in defined positions relative to one another. Specifically, one or more microphones 2 for receiving sound (i.e. acoustic signals) from the environment are disposed in the frame 11. For this purpose, a printed circuit board (PCB) carrying at least some of the electrical or electronic components is in particular folded into the frame 11.

The microphones 2 are acoustic-electric transducers for converting the sound into audio signals. A signal-processing device 3, which is likewise integrated in the housing 1, processes these audio signals. The output signal of the signal-processing device 3 is transmitted to a loudspeaker or receiver 4, which emits an acoustic signal. The sound is transmitted to the eardrum of the device wearer, possibly through a sound tube that is fixed in the auditory canal with an ear mold. The power supply for the hearing aid and particularly for the signal-processing device 3 is provided by a battery 5 that is likewise integrated in the housing 1. The signal-processing device 3, the receiver 4 and the battery 5 are likewise disposed in the frame 11 in such a way that the frame 11, with the components disposed therein, can easily be removed from the housing 1, for example in order to be able to exchange the housing 1.

The signal-processing device 3 according to the invention is also configured to process electromagnetic waves. The signal-processing device 3 has a transmitting and receiving device 6 for producing and detecting electromagnetic waves and/or for decoding. The transmitting and receiving device 6 is electrically connected to an antenna 10 in order to transmit and receive electromagnetic waves.

The antenna 10 is configured as an integral part of the frame 11, namely as a conductive structure integrated in the frame 11. The antenna 10 is mounted directly on the frame 11. It is not spaced apart from the surface and cannot be released from the frame 11 without destruction.

The antenna 10 is mounted on the frame 11 in particular by using MID technology. This is accomplished in particular by using laser direct structuring (LDS). In an alternative embodiment, the antenna 10 is printed directly onto the frame 11. The conductor structures placed onto the surface of the frame 11 are then optionally electrically insulated and protected against damage by a protective lacquer or coating.

Figure 2:
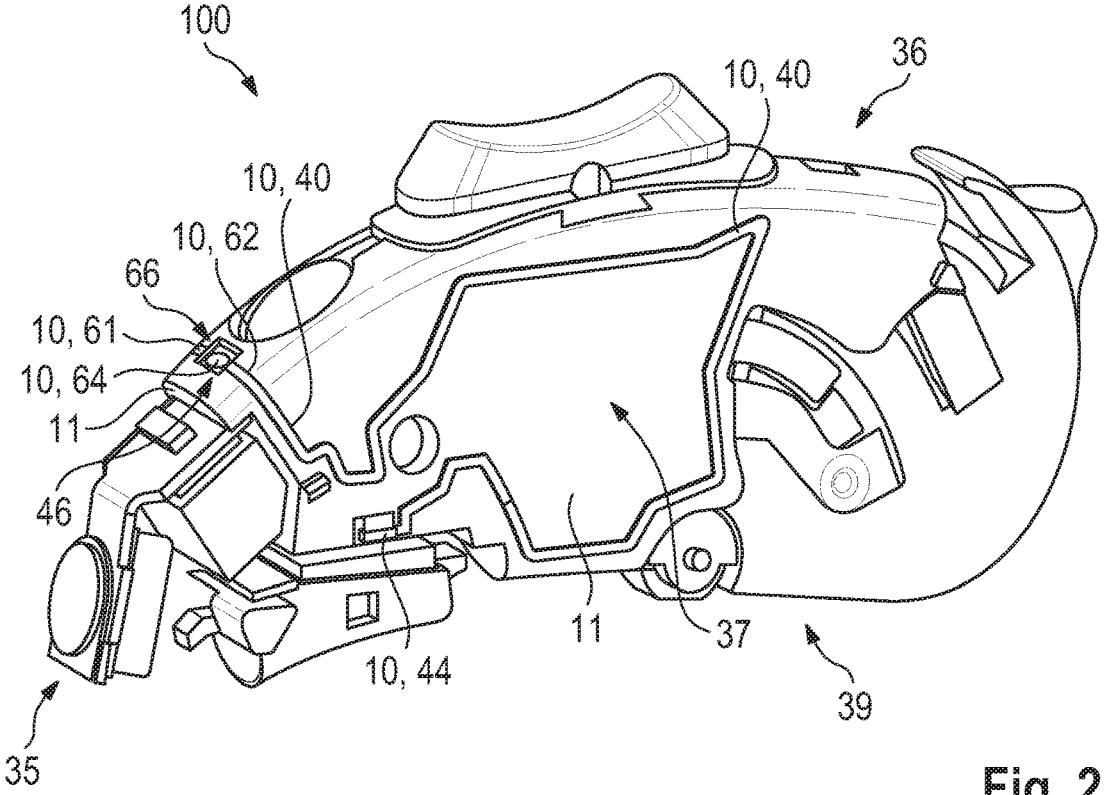
FIG. 2 is a perspective view of a first concrete embodiment of the hearing aid with a first configuration of an antenna.

FIG. 2 shows a first embodiment of the frame 11 with a first configuration of the antenna 10. An opening, below which the microphone 2 (or one of several microphones 2) is disposed, is provided on an upper face 36 of the frame 11 as is seen at the top in the view according to FIG. 2. The frame 11 also has an underside 39. Recesses in the frame 11, which are not shown explicitly, serve to accommodate the receiver 4 and the transmitting and receiving unit 6. Moreover, the frame 11 forms a battery compartment for accommodating the battery 5.

When the hearing aid 100 is operated as intended, a sound tube is attached to a tip or front 35 of the frame 11 and allows the sound generated by the receiver 4 to be conveyed to an ear mold insertable into the auditory canal of a user. The sound tube and the ear mold are not shown in FIG. 2. When the hearing aid is being worn as intended on the ear, the frame 11 is oriented in its longitudinal direction with the tip or front 35 facing forward in the viewing direction of the wearer. A transverse direction of the frame 11 is perpendicular to the viewing direction of the wearer and more or less parallel to a connecting line between the ears of the wearer. Two parts 40, 41 of the antenna 10 are disposed on lateral surfaces or flanks 37 of the frame 11.

The frame 11 is divided into two frame halves lengthwise along a dividing plane or separating plane (not shown) and each of the two frame halves having a flank 37. After the insertion of the assemblies accommodated therein, the frame halves are in this case connected by clipping, screwing, adhesive bonding and/or by using retaining pins.

In the embodiment of the hearing aid 100 shown in FIG. 2, the two parts 40, 41 of the antenna 10 each have the shape of an open loop. A first part 40 is disposed on one frame half 42, while a second part 41 is disposed on another hidden frame half.

The two parts 40, 41 of the antenna 10, seen transversely with respect to the dividing plane or separating plane of the frame 11, run parallel to each other and are thus aligned with each other. The antenna 10 therefore has mirror symmetry with respect to the dividing plane or separating plane of the frame 11.

Each of the two parts 40, 41 has two respective ends, namely an attachment end 44, 45 and a bridging conductor end 61, 62. In this case, both ends 44, 62 and 45, 61 of a respective part 40, 41 of the antenna 10 are each disposed in FIG. 2 at the same longitudinal end of the frame 11 (namely at the tip or front 35). The two bridging conductor ends 61, 62 are electrically shorted to each other through an electrical cross-connection or bridge 46 that also spans the separation of the two frame halves. The two other ends, i.e. the attachment ends 44, 45, are in contact with the transmitting and receiving device 6.

Depending on the embodiment, the bridge 46 is formed at least partly by conductor tracks, which are likewise mounted directly on the frame halves of the frame 11 using MID technology (particularly by LDS). Alternatively, the bridging conductor ends 61, 62 already abut each other, and in this case the bridging conductor ends 61, 62 are electrically connected to each other, for example by a solder point 64. That is to say, the bridge 46 is then formed by the solder point 64.

Figure 3:
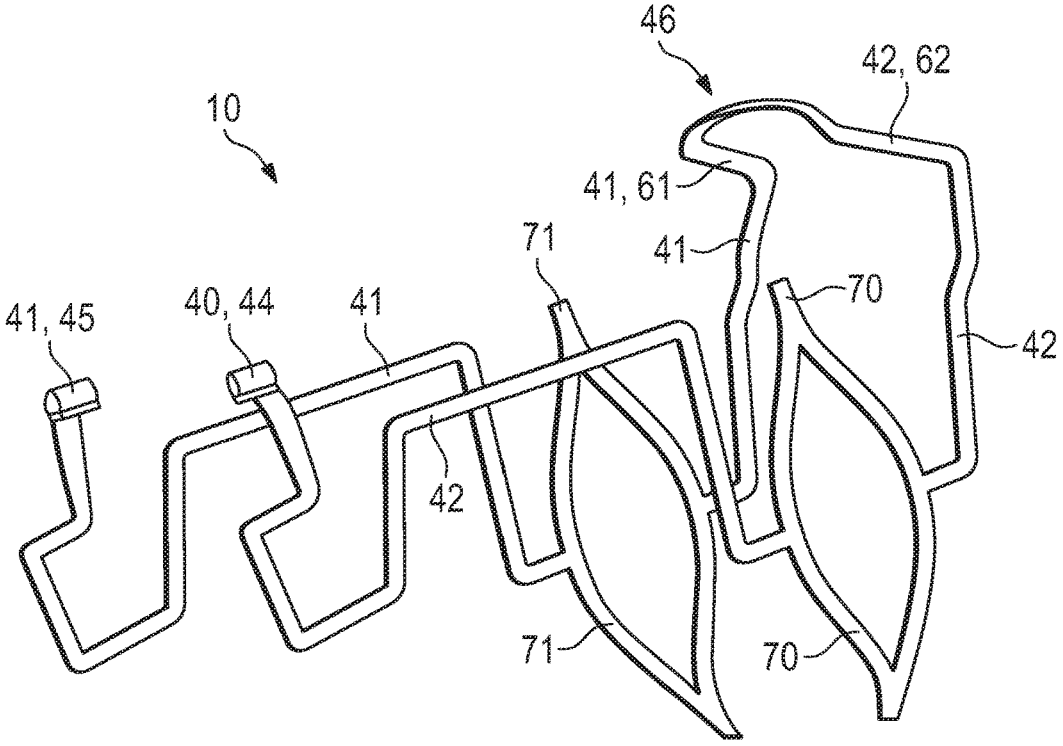
FIG. 3 is a perspective view of a second configuration of the antenna.

FIG. 3 shows an alternative embodiment of the antenna 10. In this embodiment, the bridge 46 is formed, for example, by a continuous conductor track and moreover is not disposed in the region of the front 35 but instead is routed over the upper face 36 in the rear region, i.e. on the right-hand side in the figure. Moreover, the two parts 40, 41 of the antenna 10 are not configured as open loops. Instead, they have a winding profile with several changes of direction.

Moreover, in each part 40, 41 of the antenna 10, a segment along the profile forms an auxiliary structure 70, 71. Each of the two auxiliary structures 70, 71 has the shape of a closed loop. That is to say, the first part 40 of the antenna 10 forms a first auxiliary structure 70, and the second part 41 of the antenna 10 forms a second auxiliary structure 71.

In the illustrative embodiment according to FIG. 3, the two auxiliary structures 70, 71 are of identical configuration, symmetrical and positioned opposite each other on the two flanks 37 of the frame 11.

Moreover, in the illustrative embodiment, each auxiliary structure 70, 71 has an approximately elliptical shape. The main axis of each elliptical shape preferably has a good approximation to a vertical orientation, i.e. it is vertical with respect to the earth, when the hearing aid 100 is being worn by a user. In addition, each auxiliary structure 70, 71 preferably tapers to a point at both ends, as seen in the direction of the main axis.

The invention will be particularly clear from the illustrative embodiments described above. However, it is not limited to these illustrative embodiments. Instead, many other embodiments of the invention may be derived from the claims and from the above description.

The following is a summary list of reference numerals and the corresponding structure used in the above description of the invention.

LIST OF REFERENCE SIGNS

1 housing
2 microphone
3 signal-processing device
4 receiver
5 battery
6 transmitting and receiving device
10 antenna
11 frame
35 front
36 upper face
37 flank
40 first part
41 second part
44 attachment end
45 attachment end
46 bridge
61 bridging conductor end
62 bridging conductor end
64 solder point
70 first auxiliary structure
71 second auxiliary structure
100 hearing aid

The invention claimed is:

1. A hearing aid, comprising:

a housing;

a frame inserted in said housing, said frame having an upper face, an underside, and two mutually opposite flanks;

electrical or electronic assemblies disposed in said frame, said assemblies including a unit for at least one of transmitting or receiving electromagnetic waves;

an antenna configured as an integral part of said frame, as a stamped and bent part or as an inlay part made of metal, said antenna including a bridge being an integral part of said frame;

said antenna including a first part having two ends, said first part being configured as an open loop or having a winding profile and a segment along said profile forming a first auxiliary structure with a closed loop shape, said first auxiliary structure being positioned on one of said two flanks of said frame;

said antenna including a second part having two ends, said second part having a winding profile or being configured as an open loop, said profile of said second part having a segment along said profile of said second part forming a second auxiliary structure with a closed loop shape;

one of said ends of said first part and one of said ends of said second part of said antenna being electrically shorted to each other by said bridge; and each of said first and second auxiliary structures having an elliptical shape with a vertically oriented main axis.

2. The hearing aid according to claim 1, wherein said two parts of said antenna are each positioned on a respective one of said two mutually opposite flanks of said frame, and said bridge is routed over said upper face at said frame.

3. The hearing aid according to claim 2, wherein said frame is formed of two frame halves, said first part of said antenna is disposed on one of said two frame halves and said second part of said antenna is disposed on another of said two frame halves.

4. The hearing aid according to claim 1, wherein said frame is formed of two frame halves, said first part of said antenna is disposed on one of said two frame halves and said second part of said antenna is disposed on another of said two frame halves.

5. The hearing aid according to claim 4, wherein said two frame halves are separated by a separating plane, and said first and second parts of said antenna are formed mutually symmetrically relative to said separating plane.

6. The hearing aid according to claim 1, wherein said frame is formed of two frame halves, said first part of said antenna is disposed on one of said two frame halves and said second part of said antenna is disposed on another of said two frame halves.

7. The hearing aid according to claim 1, wherein each of said first and second auxiliary structures has an oval shape.

8. The hearing aid according to claim 1, wherein each of said first and second auxiliary structures has an elliptical shape with a vertically oriented main axis, said main axis has two ends, and said elliptical shape tapers to a point at both of said ends of said main axis.

9. The hearing aid according to claim 1, wherein said housing is formed of a material, and said frame is formed of a non-conductive material having a higher permittivity than said material of said housing.

* * * * *